United States Patent [19]

Cooperrider

[11] 4,278,406

[45] Jul. 14, 1981

[54] ELECTROMAGNETIC PUMP

[75] Inventor: Myron T. Cooperrider, North Royalton, Ohio

[73] Assignee: R. W. Beckett Corporation, Elyria, Ohio

[21] Appl. No.: 92,221

[22] Filed: Nov. 7, 1979

[51] Int. Cl.[3] ..... F04B 23/10

[52] U.S. Cl. ..... 417/199 A; 417/214; 417/413; 417/417; 417/435; 417/540

[58] Field of Search ..... 417/214, 199 R, 199 A, 417/305, 417, 413, 523, 521, 540, 435, 434, 251; 92/5 R

[56] References Cited

U.S. PATENT DOCUMENTS

| | | | |
|---|---|---|---|
| 3,072,061 | 1/1963 | Cameron | 417/214 |
| 3,661,061 | 5/1972 | Bowen | 92/5 R |
| 3,802,807 | 4/1974 | Kilayko | 417/435 X |
| 3,877,840 | 4/1975 | Nakamura | 417/417 X |
| 3,877,841 | 4/1975 | Nakamura | 417/311 |
| 4,066,386 | 1/1978 | Johnson et al. | 417/435 X |

FOREIGN PATENT DOCUMENTS

| | | | |
|---|---|---|---|
| 428121 | 8/1911 | France | 417/199 A |
| 876212 | 10/1942 | France | 417/251 |
| 397426 | 2/1966 | Switzerland | 417/199 A |

*Primary Examiner*—Carlton R. Croyle
*Assistant Examiner*—Edward Look
*Attorney, Agent, or Firm*—Pearne, Gordon, Sessions, McCoy & Granger

[57] ABSTRACT

An electromagnetic pump particularly adapted for use with oil burners is disclosed. The pump embodies an armature that is reciprocated by a magnetic field produced by an electromagnetic coil. The armature drives the piston of a piston pump that is adapted to pump a liquid at low volume and high pressure. The pump also embodies a diaphragm disposed in a chamber having an inlet portion on one side of the diaphragm and an outlet portion on the other. The inlet portion of the chamber is connected to a liquid supply line leading to the pump and the outlet portion is connected to the discharge of the piston pump and also to a valve-controlled vent leading to atmosphere. The diaphragm is moved in one direction only by the armature and in the opposite direction by a spring. When there is air in the liquid supply line, the vent valve is opened and the diaphragm rapidly pumps air to the atmosphere. When liquid is discharged from the vent, the valve is closed. The discharge side of the diaphragm chamber is subject to the discharge pressure of the piston pump. This pressure holds the diaphragm in the inlet portion of the diaphragm chamber against the action of the spring when the vent valve is closed. Thus, the diaphragm becomes substantially inactive and requires substantially no power after air has been pumped out of the system and the piston pump is pumping liquid at normal discharge pressure.

16 Claims, 5 Drawing Figures

ELECTROMAGNETIC PUMP

BACKGROUND OF THE INVENTION

1. Field of the Invention

This invention relates to electromagnetic pumps, and more particularly to electromagnetic pumps of the type that are employed to deliver oil or other liquid fuel to the burners of domestic and other furnaces and similar appliances. Pumps for this service are required to supply oil at pressures of, for example, about 100 psi at fairly low rates of flow, such as 4 to 6 gallons per hour. The pump must also have sufficient capacity to evacuate air from the oil supply line when the pump is first put into service or when the pump is placed in service again after the supply line has been drained for any reason. To meet this requirement, most United States manufacturers of oil burners require pumps that have a capacity of at least 20 gallons per hour, and in the United States most oil burners are provided with gear-type pumps that are driven directly by the same motor that drives the blower for the burner. Pumps of this type, however, are not economical in their use of electric power and may become noisy and less efficient after extended periods of use.

2. Description of the Prior Art

In order to eliminate the problems encountered with gear-type pumps in connection with oil burners, piston pumps have been provided in which the piston is driven by an armature disposed in an electromagnetic field, the arrangement being such that the piston reciprocates rapidly in its cylinder and the pump is able to pump the required low volume of oil at the desired pressure. Pumps of this type are shown in the Nakamura U.S. Pat. Nos. 3,877,840 and 3,877,841, both issued Apr. 15, 1975, and have gone into substantial use in Japan in connection with oil burners. These pumps operate satisfactorily with residential oil burners where the oil is fed by gravity from a storage tank to the pump or where the lift does not exceed about two feet, or if the lift does exceed two feet, the oil supply line does not have an outside diameter of more than about ¼ inch and is not more than about 20 feet long. However, when such pumps are employed with systems embodying greater lift and long or larger diameter suction lines, they are unable to evacuate the air from the supply line and prime the pump because of the elasticity of the air column in the pipe and the limited pump displacement.

Pumps of this type, therefore, would be unsatisfactory for general use in United States residential and commercial heating systems, since such systems usually embody outside, below ground oil tanks with supply lines composed of ⅜ or ½ inch O.D. copper tubing that may be many feet in length. For this reason, pumps of the type shown in the aforesaid Nakamura patent would not be suitable for use in many United States residential and commercial heating systems. Inasmuch as the manufacturers of oil burners in the United States do not control the manner in which the burners are installed, the manufacturers must provide burners that will operate under all reasonable conditions, for this reason, electromagnetic pistontype pumps have not come into any substantial use in the oil burner industry in the United States.

SUMMARY OF THE INVENTION

A general object of the present invention is the provision of an electromagnetic pump, particularly adapted for use with oil burners, which has the ability rapidly to evacuate the air from the supply line leading to the pump, the rate of pumping of the air being several times the normal rate of discharge of liquid by the pump, and the pump also having the ability to pump liquid at the required pressure and relatively low volume after the air has been discharged from the supply line.

Another object of the invention is to provide such a pump which can be operated at low levels of electric energy consumption as compared to the positive displacement gear-type pumps presently employed with oil burners. Another object is the provision of such a pump that will operate reliably and efficiently for long periods of time, and which can be manufactured at reasonable cost.

Briefly, these and other objects and advantages of the invention are attained by providing a pump embodying a magnetic armature that is disposed within an electric coil which, when energized, causes the armature to reciprocate rapidly, and at any desired reciprocation frequency depending upon the nature and the frequency of the current supplied to the pump and the design of the electrical components. The armature is connected to a piston operating in a cylinder, the diameter and stroke of the piston and cylinder being such that the desired volume of 4 to 6 gallons per hour or more at pressures of about 100 psi can be attained readily. Suitable inlet and outlet passages are provided, along with inlet and outlet check valves, so that the reciprocation of the piston in the cylinder will result in the discharge of oil in a conventional manner.

In order to provide for rapid evacuation of air from the oil supply pipe leading to the pump, a pumping diaphragm in an appropriate chamber is also provided. The diaphragm is reciprocated by an actuating member that is driven by the piston and engages one surface of the diaphragm. An inlet passage and check valve, separate from the inlet for the cylinder, are provided for the space on one side of the diaphragm which constitutes an inlet chamber, and discharge check valves are provided in the diaphragm itself. There is a separate venting passageway from the discharge chamber that is disposed on the side of the diaphragm opposite the inlet chamber. This discharge chamber also communicates with the outlet passage from the cylinder. When the piston is moved in a first direction, a spring causes the diaphragm to move in a direction to draw air or other fluid into the inlet chamber. When the piston moves in the opposite direction, the diaphragm actuating member pushes the diaphragm in that direction and fluid in the inlet chamber of the diaphragm passes through the diaphragm check valves to the discharge chamber. On the next stroke of the diaphragm in the first direction, the fluid in the discharge chamber is ejected to atmosphere. The venting passageway has a control valve and after the diaphragm discharges oil through this passage, indicating that the air has been vented from the supply conduit and the pump, the control valve is closed. Thereafter, fluid under the discharge pressure of the pump accumulating in the diaphragm discharge chamber moves the diaphragm to a position within the inlet chamber, where it is held by the discharge pressure of the oil. The diaphragm is thus substantially eliminated from the pumping operation, and the pump then operates as a normal electromagnetic piston-type pump until such time as it again becomes necessary to vent air from the system.

An advantage of the prsent pump, however, is that after the air has been vented from the oil supply system and the pump and the vent valve has been closed, the diaphragm then provides the additional function of a pulsation absorber.

When the vent valve is closed the internal oil pressure forces the diaphragm downwardly until the pressure exerted by the oil is balanced by the force of the diaphragm spring. The diaphragm then remains substantially stationary, moving only sufficiently to act as a pulsation absorber as described below. The design of the diaphragm spring will not permit the total deflection and bottoming out of the spring at any normal pump pressure. The remaining spring movement that is available after normal pump pressure has been transmitted to the diaphragm chamber enables the diaphragm and spring to deflect an additional amount under pressure peaks developed by the piston. When each peak subsides, the diaphragm and spring return to the positions they had before the pressure peak. Thus the diaphragm and spring constitute a pulsation absorber with a large effective area that is much more effective than the conventional type that is shown. Thus, with the pump of the present invention a separate pulsation absorber of the type illustrated in the drawing and that is required on conventional electromagnetic pumps ordinarily is not necessary.

DESCRIPTION OF THE PREFERRED EMBODIMENT

Figure 1:
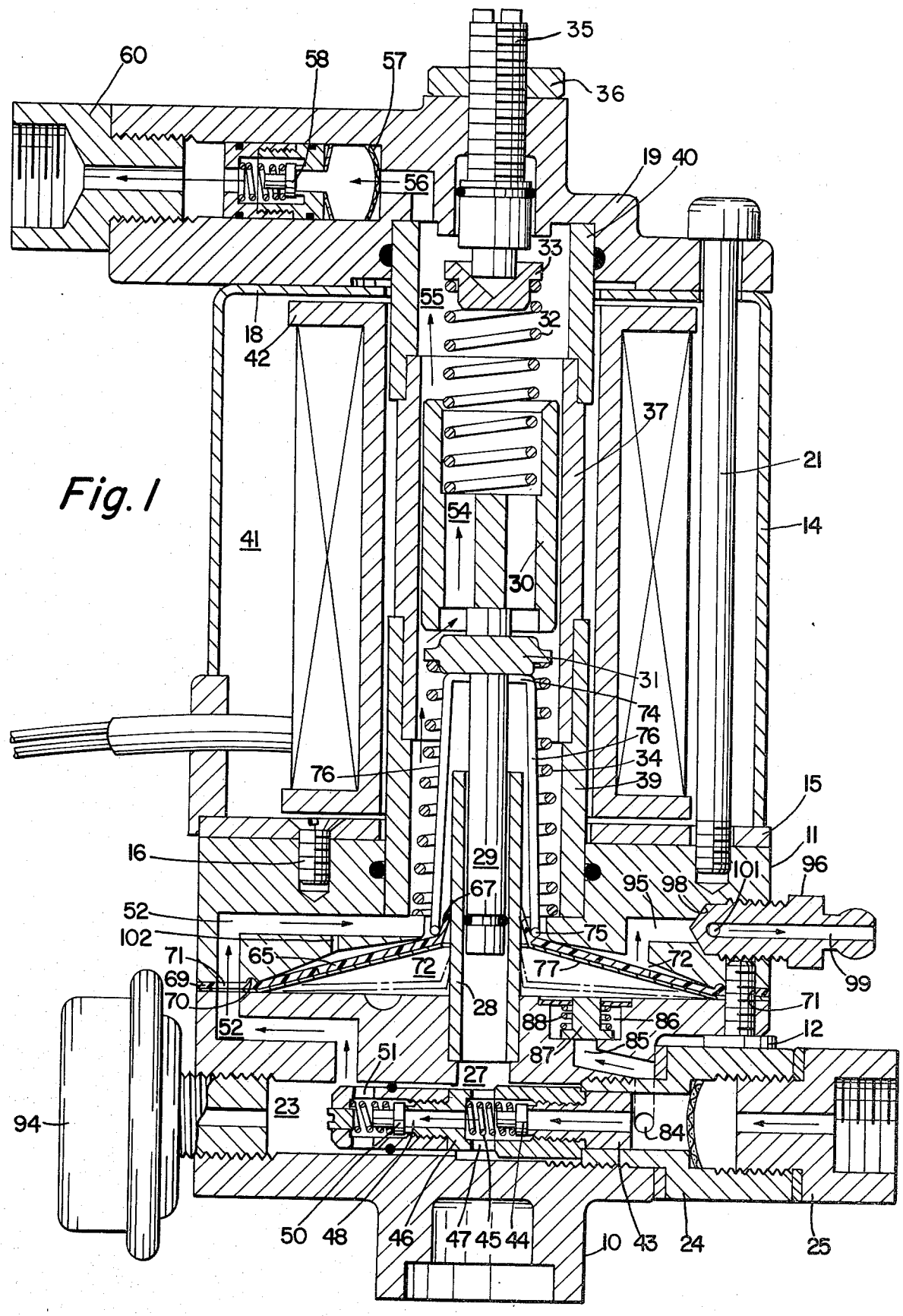
FIG. 1 of the drawing is a vertical section through a pump made according to the preferred form of the invention.

As shown in FIG. 1, the pump mechanism is enclosed in a housing comprising a base 10 to which a sub-base 11 is secured by circumferentially spaced cap screws 12, only one of which is shown. The base and sub-base are preferably substantially cylindrical in plan. The electrical components of the pump are enclosed within a sleeve 14 extending upwardly from the sub-base 11, the lower end of the sleeve resting upon a supporting plate 15 that engages the upper surface of the sub-base 11 and is secured thereto as by circumferentially spaced screws 16, only one of which is shown.

At its upper end, the sleeve 14 is provided with an inwardly turned flange 18 that supports the head 19 of the pump housing, the head being secured to the sub-base 11 by circumferentially spaced tie bolts 21, only one of which is illustrated in the drawing.

In order to provide an inlet for the pump and also a chamber for inlet and outlet check valves, the base 10 is provided with a passage 23 that is threaded at one end to receive an inlet fitting 24, which in turn receives a connector 25 to which a supply pipe may be connected by any convenient means. Gaskets as shown may be utilized to seal the fitting 24 to the base 100 and to the fitting 25.

The base 10 has a vertically extending bore 27 that intersects the bore 23 and is enlarged as shown to receive the cylinder 28. The cylinder 28 may be secured within the enlarged bore by a press fit, by brazing or any convenient means. A piston 29 is reciprocated in the cylinder, when the pump is turned on, by a magnetic armature 30 that actuates the piston through a piston head member 31. A spring 32 acting between an adjustable seat 33 and the armature urges the armature downwardly, while a spring 34 maintains the piston head 31 in engagement with the armature. The armature reciprocates in the central section 37 of an armature guide member, which is completed by a lower section 39 and an upper section 40. Conventional seals or packings such as O-rings, as shown, are provided to prevent leakage between interfitting parts of the pump and to provide a seal between the piston 29 and cylinder 28. Magnetic force to operate the armature is provided by a coil 41 conventionally wound on a spool 42 that surrounds the armature tube 37. Power is supplied to the coil through conventional leads.

The force exerted by the spring 32 on the armature, and thus the discharge pressure of the piston, can be controlled in a conventional manner by an adjusting screw assembly 35 threaded in head 19 and engaging the spring seat 33. By screwing the adjusting screw downwardly, the force exerted by the spring 32 on the armature can be increased, and thus the pump discharge pressure can be increased. A lock nut 36 is provided to lock the adjusting screw assembly in desired positions of adjustment.

In order to provide for the flow of fluid to the cylinder 28, the inlet fitting 24 has at its inner end an inlet check valve fitting 43, the inner end of which provides a seat for the valve 44, which is urged toward the seat by a spring 45 that is retained by discharge check valve member 46. Valve member 46 has a cross drilled opening 47 through which fluid drawn through the inlet check valve on the upstroke of the piston 29 can flow to the bore 27 and then to the interior of the cylinder 28.

Upon the succeeding downstroke of the piston 29, fluid in the cylinder 28 is ejected through the cross-drilled opening 47 and then the bore 48 of the discharge check valve member 49, flowing past the check valve 50 through the cross-drilled opening 51 into the bore 23.

From the bore 23, fluid can flow through the passages 52 into the space within the armature guide 39 surrounding the cylinder 28 and then, as shown by the arrows, upwardly around the piston and piston head through the passages 54 in the armature to the space 55 above the armature. The fluid then flows through passage 56 and screen 57 to the discharge check valve 58, of conventional construction, to the outlet fitting 60, which may be appropriately connected to the burner.

The parts just described are, in general, conventional and, as noted above, a pump of this type embodying only an electromagnetically actuated piston is not satisfactory for use in many installations because of insufficient capacity to remove air from the supply lines leading from the oil storage tank to the pump.

Figure 2:
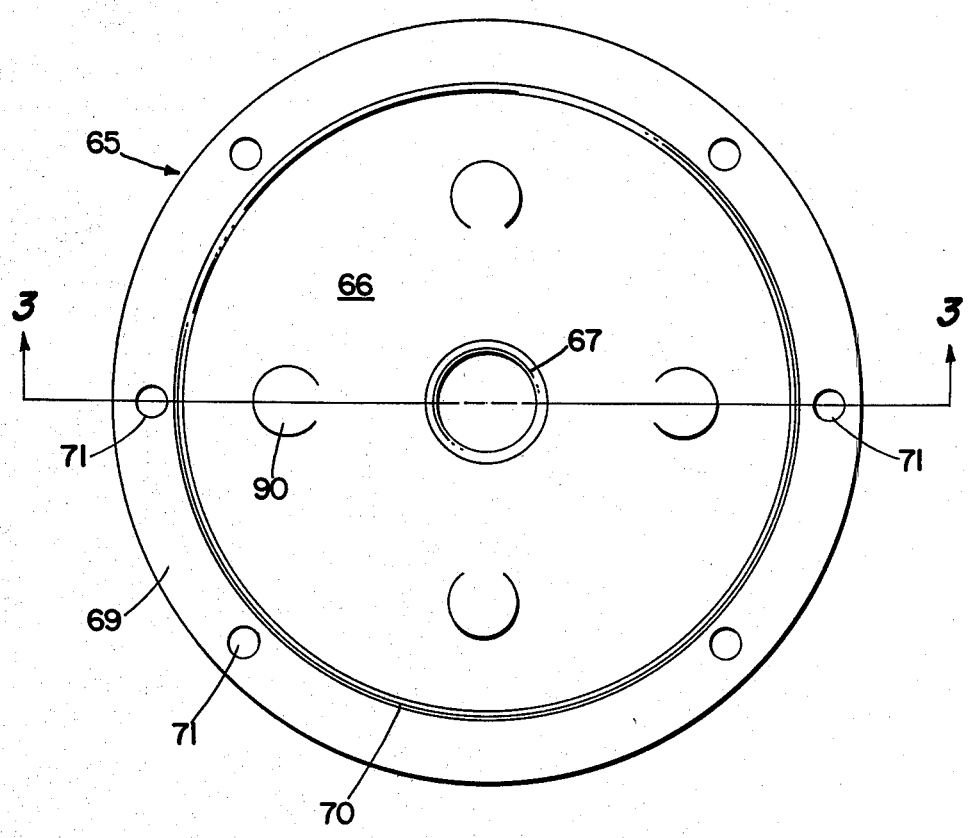
FIG. 2 is a plan view of the diaphragm employed in the pump of FIG. 1.
Figure 3:
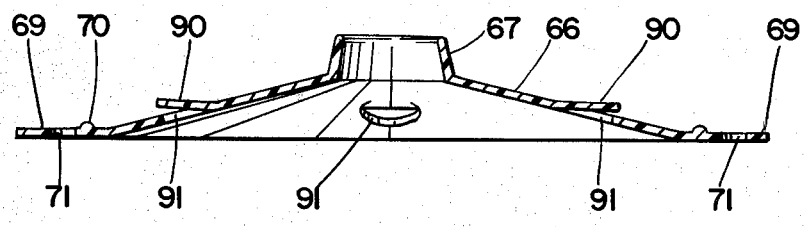
FIG. 3 is a section taken on line 3—3 of FIG. 2.

In accordance with the present invention, this problem is obviated by the provision of a pumping diaphragm 65 that is driven by the magnetic armature 30 that drives the piston 29. The diaphragm, which is illustrated in FIGS. 2 and 3, has a conical body portion 66 and a central, upwardly extending chevron-type sealing portion 67 that makes sliding, sealing engagement with the exterior of the cylinder 28 so that fluid pumped by the piston 29 and traveling in the discharge passage 52 and around the exterior of the cylinder cannot flow downwardly around the exterior of the cylinder 28 to the space beneath the diaphragm.

In order to seal the diaphragm to opposed surfaces of the base 10 and sub-base 11, the diaphragm is provided with an annular, outer flange 69 that is flat except for a sealing bead 70. Flange 69 is clamped between opposed surfaces of base 10 and sub-base 11, the flange being provided with openings 71 to receive the cap screws 12 that clamp the base and sub-base together. The sub-base 11 is recessed, as shown, to receive and make sealing engagement with the bead 70. One of the openings 71 is in alignment with the discharge passage 52 so that the flange of the diaphragm will not interfere with the flow of fluid through this passage.

The upper surface of the base 10 within the area beneath the diaphragm is substantially flat, the cavity 72 in which the diaphragm operates being formed in the lower surface of the sub-base 11. The diaphragm divides the cavity 72 into an inlet chamber beneath the diaphragm and an outlet chamber above the diaphragm.

In operation, the diaphragm is moved from the upper position shown in full lines to the lower position shown in broken lines by a diaphragm actuator made up of an upper portion 74 engaged by the undersurface of the piston head 31 and connected to a ring 75 by three downwardly and outwardly extending struts 76. The ring 75 engages the upper surface of the diaphragm immediately surrounding the juncture of the seal 67 and the conical portion 66 of the diaphragm. Thus, on the downstroke of the armature and piston, the diaphragm is moved to the position shown in broken lines in FIG. 1, in which it is slightly spaced from the base 10.

Figure 4:
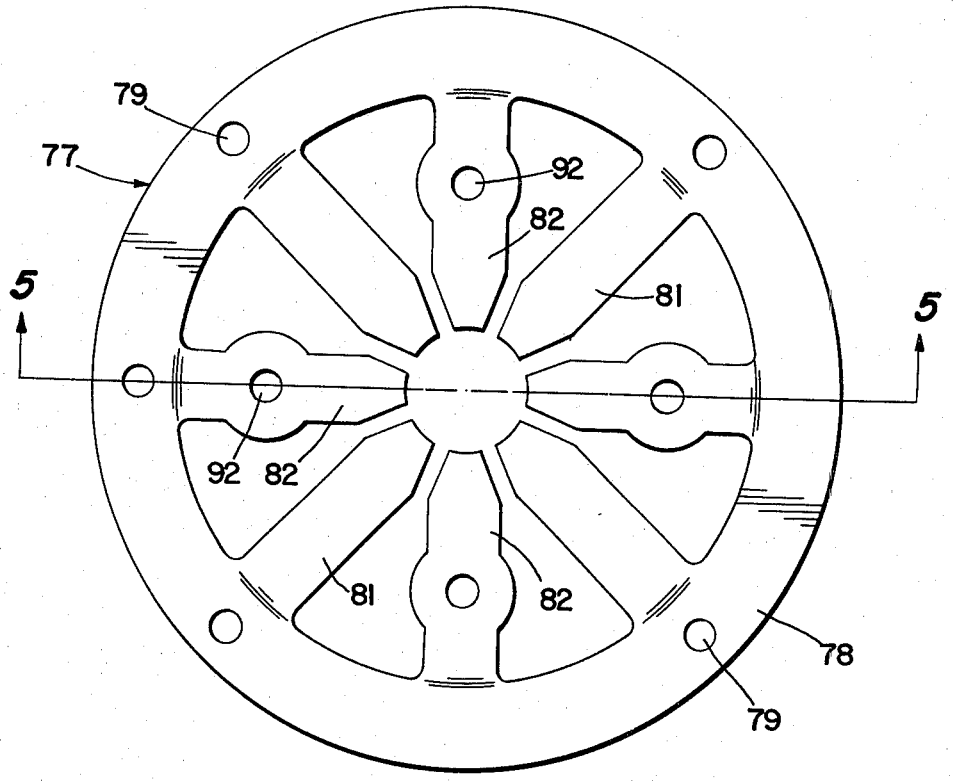
FIG. 4 is a plan view of the diaphragm spring employed in the pump of FIG. 2.
Figure 5:
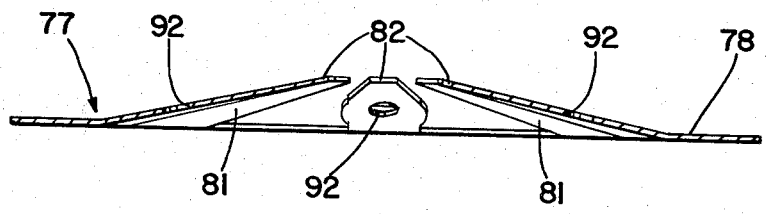
FIG. 5 is a section taken along line 5—5 of FIG. 4.

A diaphragm spring 77 is disposed immediately beneath the diaphragm, and functions to return the diaphragm to its upper, full line position when the piston moves upwardly. Spring 77 is shown in FIGS. 4 and 5 and comprises an outer, substantially flat, annular, peripheral portion 78 that underlies the flange 69 of the diaphragm and is provided with openings 79 that coincide with the openings 71 of the diaphragm to receive the cap screws 12 and permit passage of fluid through the passage 52.

Spring fingers 81 and 82 that are angularly spaced around the annular portion 78 extend inwardly and upwardly in a conical form from the annular portion. These fingers support the diaphragm, constantly urge it upwardly toward the full line position of FIG. 1, and are bent downwardly when the diaphragm is pushed downwardly by the actuator 74 to the position shown in broken lines in FIG. 1.

In order to provide for pumping action to take place upon actuation of the diaphragm, and particularly for the pumping of air, the inlet member 24 is provided with a cross-drilled opening 84 that communicates with a passage 85 in the base 10 leading to a chamber 86 in which there is an inlet check valve 87 seated on the bottom surface of the chamber 86 by a spring 88. This valve admits air or other fluid to the chamber 72 beneath the diaphragm 65 when the diaphragm moves upwardly, but prevents discharge of fluid from beneath the diaphragm when the diaphragm moves downwardly.

To provide for admission of fluid to the discharge chamber above the diaphragm on downward movement of the diaphragm, while preventing fluid from flowing from the upper side of the diaphragm to the lower side thereof on upward movement of the diaphragm, the diaphragm is provided with a plurality of integrally formed discharge check valves each comprising a flap 90 and an opening 91 immediately beneath the flap. Upon downward movement of the diaphragm, the flaps take the open position shown in FIG. 3, and on upward movement of the diaphragm, the flaps move downwardly into engagement with the surrounding surface of the diaphragm, blocking flow of fluid through the openings 91. The radially inwardly extending spring fingers 82 of the spring 77 are angularly spaced the same distances as the openings 91 and on the upward stroke of the piston, the vanes 82 support the flaps 90 against the fluid pressure above the piston. On the downward stroke of the diaphragm, fluid beneath the diaphragm can flow through the openings 92 in the vanes 82 and then through the aligned openings 91 in the diaphragm. The intermediate spring vanes 81 simply support the diaphragm and urge it in the upward, or discharge, direction.

Fluid pumped by the diaphragm can travel, along with fluid pumped by the piston, through the space surrounding the cylinder, the passages 54 in the armature 30 and through the discharge check valve 58 to the fitting 60, and thence to the burner. However, in order to provide for rapid discharge of air at low pressure by the diaphragm, a venting passageway 95 is formed in the sub-base 11. This leads to a threaded opening in which a vent fitting 96 is disposed. Fitting 96 has a conical end 98 that engages a corresponding conical seat surrounding passage 95, as shown. Fitting 96 is provided with a central bore 99, and is cross-drilled, as at 101, so that when the fitting 96 is unscrewed a few turns from its seat, air or other fluid can flow from the discharge passageway 95 through the cross-drilled passage 101 and be vented through the discharge bore 99. Fitting 96 thus constitutes a simple and effective valve to control the venting of fluid from the supply line to atmosphere.

In operation, assuming that the burner is to be placed in service the first time, the interior of the pump, as well as the oil supply line, will be full of air, although the interior of the pump will be wet with oil from factory testing. The vent fitting 96 is unscrewed three or four turns to enable air to be pumped through the center hole 99 to atmosphere. Power is then applied to the pump, the piston reciprocates, and the pump piston starts pumping air at a displacement of, for example, four to six gallons per hour. The diaphragm actuator 74 is engaged by the piston head 31 and pushed downwardly on the downstroke of the piston. This movement depresses the diaphragm 65 against the force exerted by the diaphragm return spring 77. Air in the inlet chamber beneath the diaphragm passes through the diaphragm check valves, lifting the flaps 90, as shown in FIG. 3. At the same time, air in the cylinder 28 is discharged by the piston 29 past the discharge check valve 50 through the passages 51 and 52 and, ultimately, to the discharge fitting 60.

On the upward reciprocation of the piston, the diaphragm actuator moves upwardly along with the piston head, and the spring 77 moves the diaphragms upwardly to the position shown in full lines in FIG. 1. As this action takes place, the check valves 90 close and air in the space above the diaphragm, which constitutes a discharge chamber, is discharged through the passage 95 and the vent fitting 96 to atmosphere as the volume of the discharge chamber is reduced. Air above the diaphragm can also be discharged through the small opening 102 leading from the diaphragm chamber to the passage 52. At the same time, air is drawn into the cylinder 28 by the upward movement of the piston 29, which increases the volume of the inlet chamber.

This pumping action continues as long as air remains in the system and the power is turned on, air being drawn to the underside of the diaphragm, which constitutes an inlet chamber, while being discharged from the discharge chamber on the upper side of the diaphragm on the upward stroke of the piston. Air flows through the check valves from the inlet chamber on the underside of the diaphragm to the discharge chamber on the upper side of the diaphragm on the downward stroke of the piston. Since the diaphragm has a displacement many times the displacement of the pump piston, air will be evacuated rapidly from the system; preferably, the air pumping capacity of the diaphragm should be at least 23 gallons per hour.

When most of the air has been evacuated from the system, oil will flow through the passage 85 and the check valve 87 to the underside of the diaphragm on each upward stroke thereof. On each downward stroke, oil below the diaphragm will pass through the flap valves 91 and on the succeeding upward stroke, this oil will be discharged through the passages 95 and 99 to atmosphere. When it is seen that a substantially solid stream of oil is being discharged through the vent fitting 96, the fitting is screwed in, closing the vent to atmosphere. The pump then develops its normal operating pressure of, for example, 100 psi after any air that is trapped above the diaphragm is forced out through the normal pump discharge passageways and discharge fitting 60. Thereafter the pump displacement automatically adjusts itself to the burner nozzle flow rate.

After the air has been discharged, the pressure developed in the oil by the piston, acting upon the upper surface of the diaphragm, forces the diaphragm downwardly to the broken line position shown in FIG. 1 against the action of the spring. The spring is designed so that it balances the force exerted on the diaphragm by normal pressure of the liquid being pumped when the diaphragm and spring are near but not completely supported by the upper surface of the base 10 during the downward or pumping stroke of the piston 29. The spring is not urged solidly against the base 10 by normal pump discharge pressure. Therefore, if a pressure peak is produced by the piston, the diaphragm can move downwardly a slight amount, absorbing the pressure pulsation as explained above. However, the upper surface of the base 10 within the diaphragm chamber provides a support for the spring and diaphragm that limits deflection of the spring and diaphragm under excessive pump discharge pressure and thus prevents damage to these elements by unduly high discharge pressures. Also, when the piston is moving upwardly during its inlet stroke, a momentary reduction in pressure above the diaphragm may take place, in which case the diaphragm may be moved upwardly slightly by the spring 77. These actions diminish any pulsations that may be present in the pump discharge. Because of these actions, although a conventional pulsation absorber 94 is shown in FIG. 1, the diaphragm itself usually acts as a pulsation absorber to a sufficient extent to eliminate the necessity for providing a separate pulsation absorber.

Once the pump is operating at its rated pressure as described, the diaphragm, except for slight movement caused by its operation as a pulsation absorber, remains in its down position, since there is a one-way connection between the armature and the diaphragm, the armature being able to apply force to the diaphagm only in the downward direction. If the diaphragm actuator 74 is secured to the piston head 31 as suggested above, the diaphragm actuator will continue to reciprocate with the piston, but, since the actuator can only move the diaphragm in the downward direction, there is substantially no load imposed by this motion on the piston head. If the actuator is not secured to the piston head, it will simply remain resting against the upper surface of the diaphragm. In either event, the diaphragm and diaphragm actuator impose essentially no load on the piston and armature, and only the power necessary to drive the piston is required. Thus during normal operation, after the air has been evacuated, the diaphragm requires substantially no additional current, and the diaphragm is not subject to wear.

The pump will operate in this mode until such time as it becomes necessary again to evacuate air from the system. This may be required if there should be leakage in the oil inlet line, or if for any reason it should become necessary to disconnect the inlet line from the pump or the oil tank is pumped out. Under such circumstances, and under any circumstances in which air is admitted to the supply line, the pump can be placed back into full operation promptly by simply opening the vent fitting 96, starting the pump, and closing the vent fitting after air has been evacuated from the line and the pump starts to discharge liquid from the vent.

From the foregoing description of the preferred form of my invention, it will be seen that the invention provides a simple and effective electromagnetic pump particularly adapted for use with domestic oil burners. By combining piston and diaphragm pumping elements, the pump is able rapidly to evacuate air from the system upon start-up or for any other reason that air accumulates in the inlet tube. Once air has been evacuated, the pump operates as a simple electromagnetic piston pump without any substantial load being imposed on the armature by the presence of the diaphragm, since the diaphragm is effectively cut out of the operational circuit after the air is removed. The pump therefore retains the advantages of low power consumption characteristic of electromagnetic piston pumps, while having the capability of evacuating air from the inlet system in a short period of time. The design of the pump also makes possible its manufacture at reasonable cost.

Those skilled in the art will appreciate that modifications in the invention can be made without departing from the teachings thereof. The essential characteristics of the invention are set forth in the appended claims.

What is claimed is:

1. In a pump comprising a cylinder, a piston, means for reciprocating the piston within the cylinder, an inlet passage, and a discharge passage associated with the cylinder, an inlet check valve and a discharge check valve controlling said inlet and discharge passages, respectively, whereby fluid in said inlet passage is pumped to said discharge passage when said piston is reciprocated, the improvement which comprises the provision of a diaphragm, means providing a chamber in which said diaphragm is disposed, said chamber being divided by said diaphragm into an intake portion and a discharge portion, valve means permitting flow of fluid from said intake portion to said discharge portion while preventing fluid from flowing from said discharge portion to said intake portion, a diaphragm actuator adapted to move said diaphragm only in the direction in which the volume of the discharge portion is increased and the volume of the intake portion is decreased, a spring adapted to move said diaphragm in the opposite direction in which the volume of said intake portion is increased and the volume of said discharge portion is decreased to discharge fluid therefrom, means providing communication between said discharge portion and said discharge passage associated with said cylinder whereby the diaphragm is subjected to the discharge pressure created by operation of said pump, the diaphragm remaining substantially stationary at a balanced position where force exerted on the diaphragm by the normal discharge pressure of the fluid being pumped by the piston is balanced by the force that the spring exerts on the diaphragm in the opposite direction, the displacement per stroke of the diaphragm being substantially greater than the displacement per stroke of the piston in the cylinder, whereby the pump is capable of pumping at low discharge pressure a volume of fluid equal to the sum of the displacements of the diaphragm and of the piston on each stroke thereof, the diaphragm becoming substantially inactive and the pump discharging only the fluid displaced by the piston when the diaphragm becomes substantially stationary as aforesaid.

2. A pump according to claim 1, wherein the piston is reciprocated by an armature operatively associated with an electromagnetic coil and said diaphragm actuator comprises a rigid member adapted to transmit the movement of said armature to said diaphragm in one direction only, said actuator being ineffective to move said diaphragm in the opposite direction.

3. A pump according to claim 2, wherein said spring is disposed in said intake portion of said diaphragm chamber and is adapted to move said diaphragm in a direction opposite to the direction in which the diaphragm is moved by said actuator.

4. A pump according to claim 3 wherein said diaphragm is capable of movement beyond said balanced position under pulsations of greater than normal pump discharge pressure, whereby said diaphragm acts as a pulsation absorber.

5. A pump according to claim 4 wherein said chamber has a supporting surface adapted to support said diaphragm and diaphragm spring against excessive deflection under greater than normal fluid pressure exerted on the diaphragm.

6. A pump according to claim 5 wherein said supporting surface is spaced sufficiently from said spring to permit said diaphragm and spring to move beyond said balanced position under the influence of pulsations of greater than normal fluid pressure.

7. A pump according to claim 1 wherein said valve means comprises a check valve permitting fluid to pass from said intake portion to said discharge portion while preventing fluid from passing from said discharge portion to said intake portion, whereby when the diaphragm is moved in a direction to increase the size of the intake portion and decrease the size of the discharge portion fluid is drawn from said inlet passage into said intake portion and is discharged from said discharge portion.

8. A pump according to claim 7, wherein said check valve is carried by said diaphragm.

9. A pump according to claim 8, wherein said check valve comprises an opening through said diaphragm and a flap carried by said diaphragm and adapted to prevent flow of fluid through said opening upon movement of the diaphragm in one direction while permitting flow of fluid through said diaphragm when the diaphragm is moved in the opposite direction.

10. A pump according to claim 9, wherein said diaphragm has a plurality of said openings and flaps that are circumferentially spaced from each other.

11. A pump according to claim 1, having means for connecting said discharge chamber to a discharge conduit separate from said discharge passage associated with the cylinder and valve means for controlling the flow of fluid through said conduit.

12. A pump according to claim 11, wherein said valve means is adapted to control the flow of fluid through said conduit to atmosphere.

13. A pump according to claim 9, wherein the diaphragm has a circular peripheral portion clamped to the means providing the chamber in which the diaphragm is disposed and wherein said diaphragm spring is disposed in the intake portion of said chamber and has a peripheral portion that is clamped into engagement with the peripheral portion of the diaphragm, said diaphragm having a plurality of spring fingers extending radially inwardly from said peripheral portion of said spring, said fingers being formed to resiliently urge said diaphragm in a direction to decrease the size of said discharge portion and discharge fluid therefrom.

14. A pump according to claim 13, in which the diaphragm is provided with a plurality of check valves each comprising an opening through the diaphragm and a flap joined to the diaphragm and adapted to overlie the opening and prevent fluid from passing in one direction through the opening when the diaphragm is moved in one direction and, when the diaphragm is moved in the opposite direction, to be moved away from the diaphragm and to permit fluid to pass through the associated opening, there being one of the radially inwardly extending spring fingers of the diaphragm spring disposed immediately beneath each such check valve and adapted to support the flap against pressure of fluid exerted upon it when the diaphragm is moved in said one direction, and each such spring finger having an opening therethrough in substantial alignment with the opening of the check valve with which the spring finger is associated.

15. An electromagnetic pump comprising a cylinder, a piston reciprocable within the cylinder, a coil, an armature within the coil and arranged to be reciprocated when the coil is energized, the armature being operatively connected to the piston whereby the piston is reciprocated when the armature is reciprocated, an inlet passage and a discharge passage associated with said cylinder, an inlet check valve in said inlet passage and a discharge check valve in said discharge passage whereby fluid in said inlet passage is pumped to said discharge passage when said piston is reciprocated, a diaphragm concentric with said cylinder, means providing a chamber in which said diaphragm is disposed, said chamber being divided by said diaphragm into an intake portion and a discharge portion, a diaphragm actuator engageable by said armature and adapted to engage said diaphragm and move it in one direction only in synchronism with said piston, a diaphragm spring disposed in said chamber in engagement with said diaphragm and adapted to move the diaphragm in the opposite direction whereby the diaphragm can be operated in synchronism with said piston, an inlet passage leading to said intake portion, an inlet check valve associated with said inlet passage, means providing communication between said discharge portion and said discharge passage associated with said cylinder, whereby said discharge portion is subject to the fluid pressure in said discharge passage, a passage leading from said discharge portion to a discharge conduit separate from said discharge passage associated with said cylinder, a check valve in said diaphragm permitting fluid to pass from said intake portion to said discharge portion while preventing fluid from passing from said discharge to said intake portion, whereby when the diaphragm is moved in a direction to increase the size of the intake portion and decrease the size of the discharge portion fluid is drawn from said inlet into said intake portion and is discharged from said discharge portion into said discharge conduit, and when said diaphragm is moved in the opposite direction fluid is constrained to flow through said check valve from said intake portion to said discharge portion, said discharge conduit leading from said discharge portion to atmosphere, and valve means for controlling the flow of fluid through said discharge conduit.

16. An electromagnetic pump according to claim 15, wherein said diaphragm is moved by the pressure of fluid in said discharge portion to a position wherein the force exerted by normal discharge pressure in the discharge chamber is balanced by the opposing force exerted by the diaphragm spring on the diaphragm, said diaphragm and spring being capable of movement beyond said balance position under the influence of pressure pulses of greater than normal fluid pressure, whereby said diaphragm acts as a pulsation absorber.

* * * * *